US006703607B2

(12) United States Patent
Stott et al.

(10) Patent No.: US 6,703,607 B2
(45) Date of Patent: Mar. 9, 2004

(54) AXIAL EJECTION RESOLUTION IN MULTIPOLE MASS SPECTROMETERS

(75) Inventors: William R. Stott, King City (CA); Bruce Collings, Bradford (CA); Frank Londry, Peterborough (CA); James Hager, Mississauga (CA)

(73) Assignee: MDS Inc., Concord (CA)

( * ) Notice: Subject to any disclaimer, the term of this patent is extended or adjusted under 35 U.S.C. 154(b) by 0 days.

(21) Appl. No.: 10/159,766

(22) Filed: May 30, 2002

(65) Prior Publication Data

US 2003/0222210 A1 Dec. 4, 2003

(51) Int. Cl.[7] ..... H01J 49/42; H01J 49/26; H01J 49/00

(52) U.S. Cl. ..... 250/282; 250/281; 250/288; 250/292; 250/293

(58) Field of Search ..... 250/281, 282, 250/288, 292, 293, 299

(56) References Cited

U.S. PATENT DOCUMENTS

| | | | | | |
|---|---|---|---|---|---|
| 4,861,988 | A | | 8/1989 | Henion et al. | 290/288 |
| 5,206,506 | A | * | 4/1993 | Kirchner | 250/281 |
| 6,111,250 | A | | 8/2000 | Thomson et al. | 250/282 |
| 6,177,668 | B1 | | 1/2001 | Hager | 250/282 |
| 6,285,027 | B1 | * | 9/2001 | Chernushevich et al. | 250/287 |
| 6,504,148 | B1 | * | 1/2003 | Hager | 250/282 |
| 6,507,019 | B2 | * | 1/2003 | Chernushevich et al. | 250/287 |
| 6,534,764 | B1 | * | 3/2003 | Verentchikov et al. | 250/287 |
| 2002/0024010 | A1 | * | 2/2002 | Hager | 250/282 |
| 2002/0030159 | A1 | * | 3/2002 | Chernushevich et al. | 250/287 |
| 2002/0121594 | A1 | * | 9/2002 | Wang et al. | 250/281 |
| 2002/0175279 | A1 | * | 11/2002 | Hager | 250/282 |

* cited by examiner

*Primary Examiner*—John R. Lee
*Assistant Examiner*—Bernard Souw
(74) *Attorney, Agent, or Firm*—Alice O. Martin; Barnes & Thornburg

(57) ABSTRACT

An improved method of operating a mass spectrometer having a linear ion trap wherein ions are axially ejected from the trap to a detector or subsequent mass analysis stage. The DC barrier field produced at the exit lens of the trap is scanned in conjunction with the scanning of other fields used to energize ions of select mass-to-charge ratios past the barrier field/exit lens. The technique can maximize the resolution obtainable from axial ejection over a wide mass range.

15 Claims, 12 Drawing Sheets

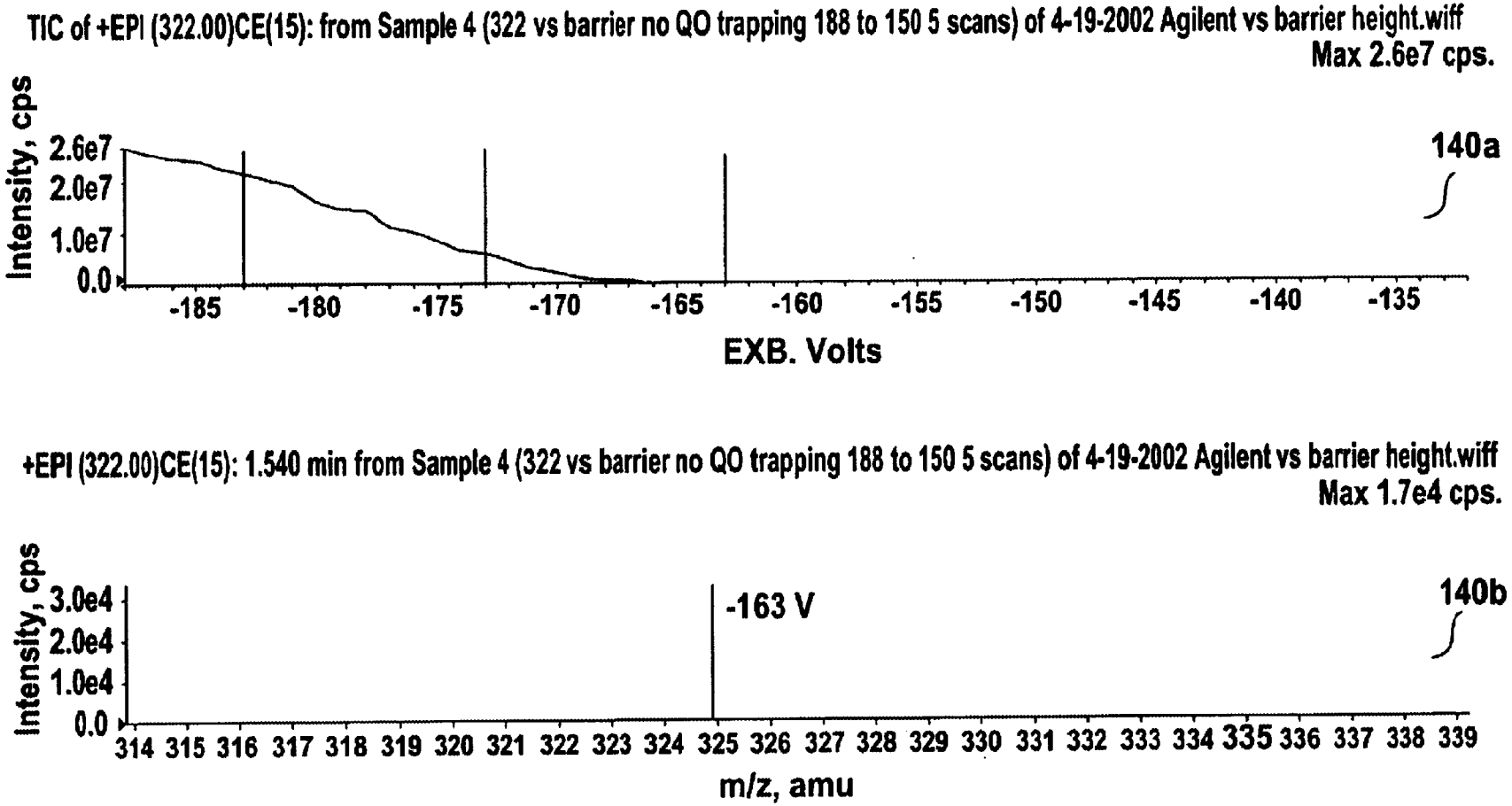
FIG. 4A-a

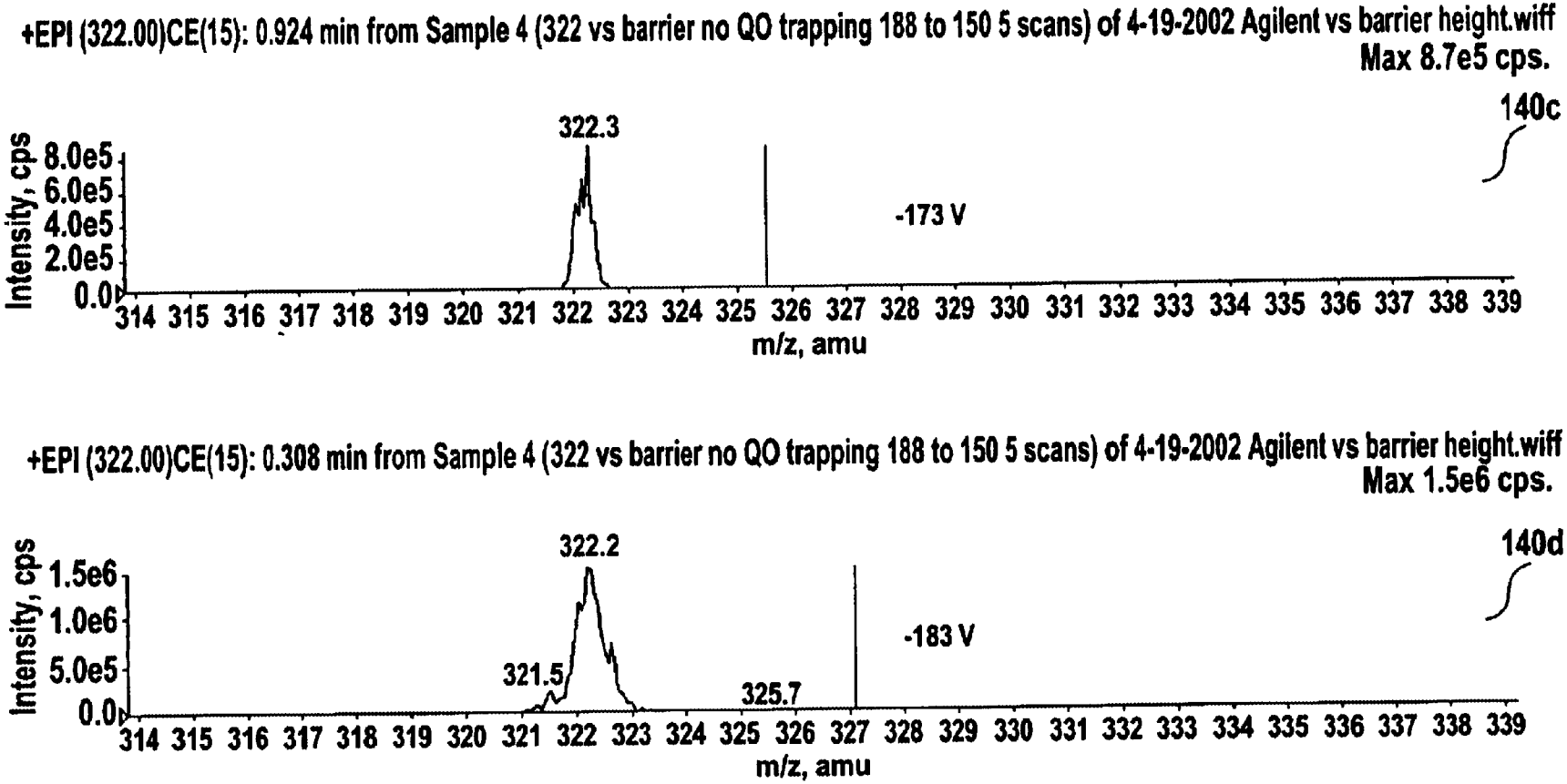
FIG. 4A-b

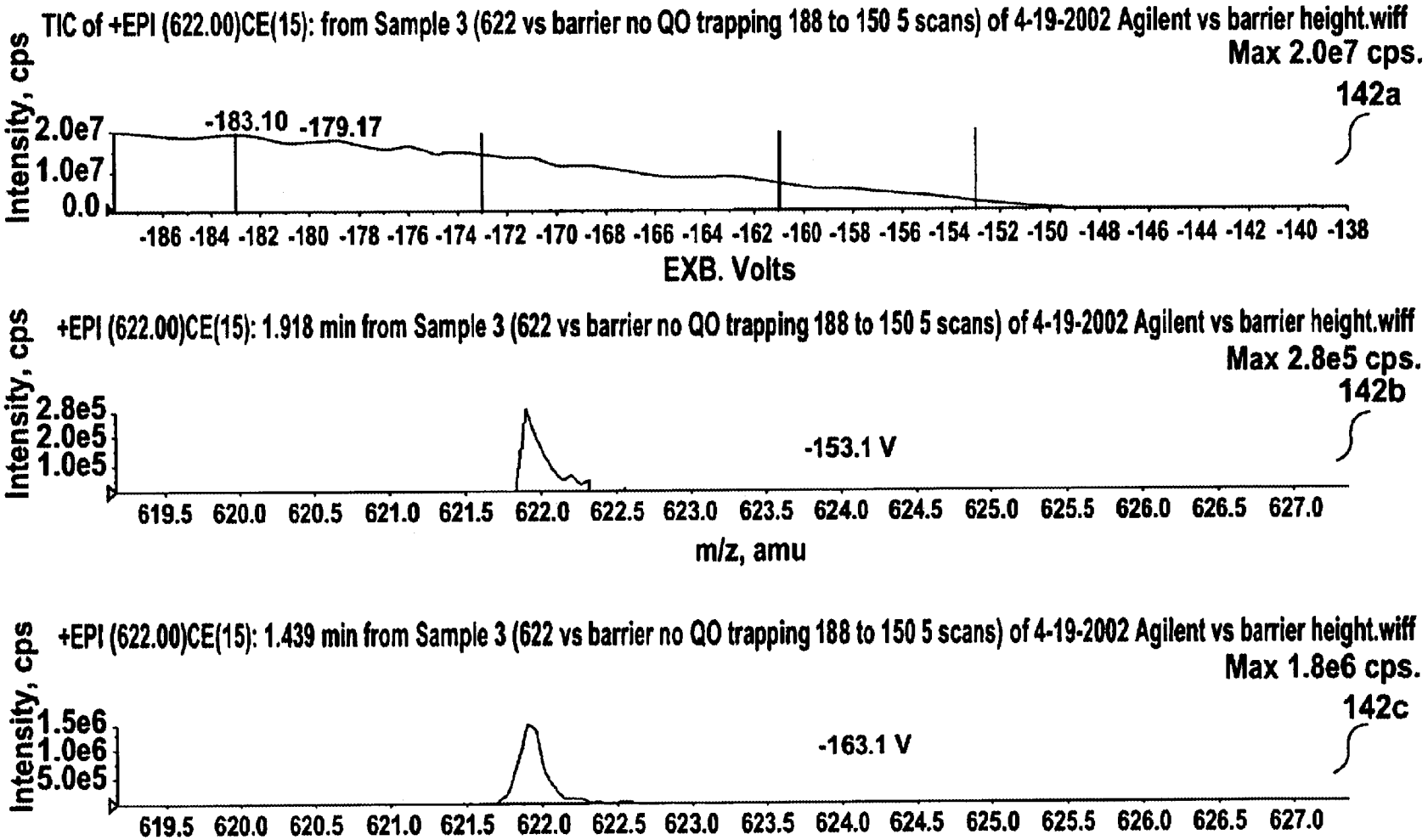
FIG. 4B-a

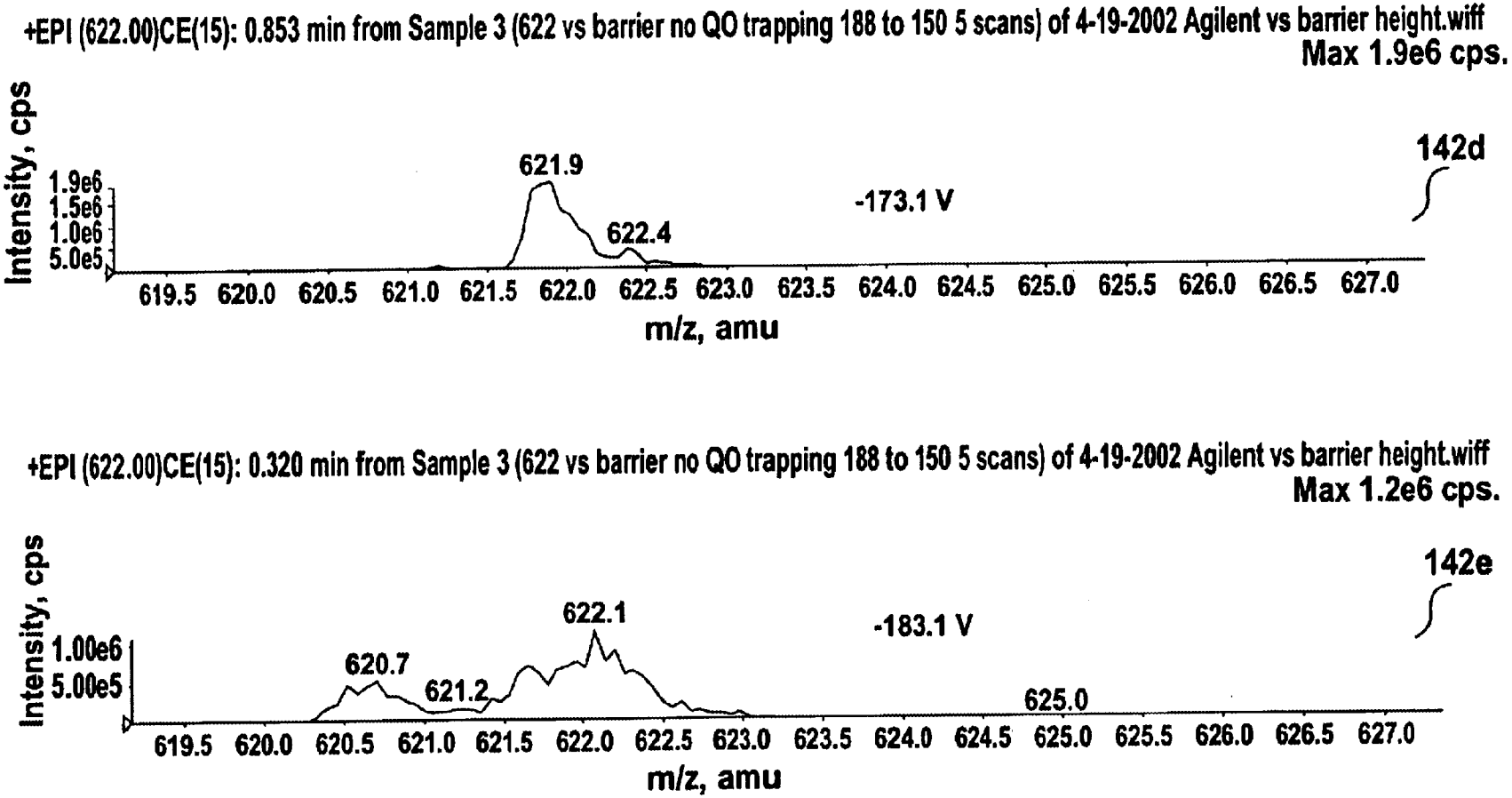
FIG. 4B-b

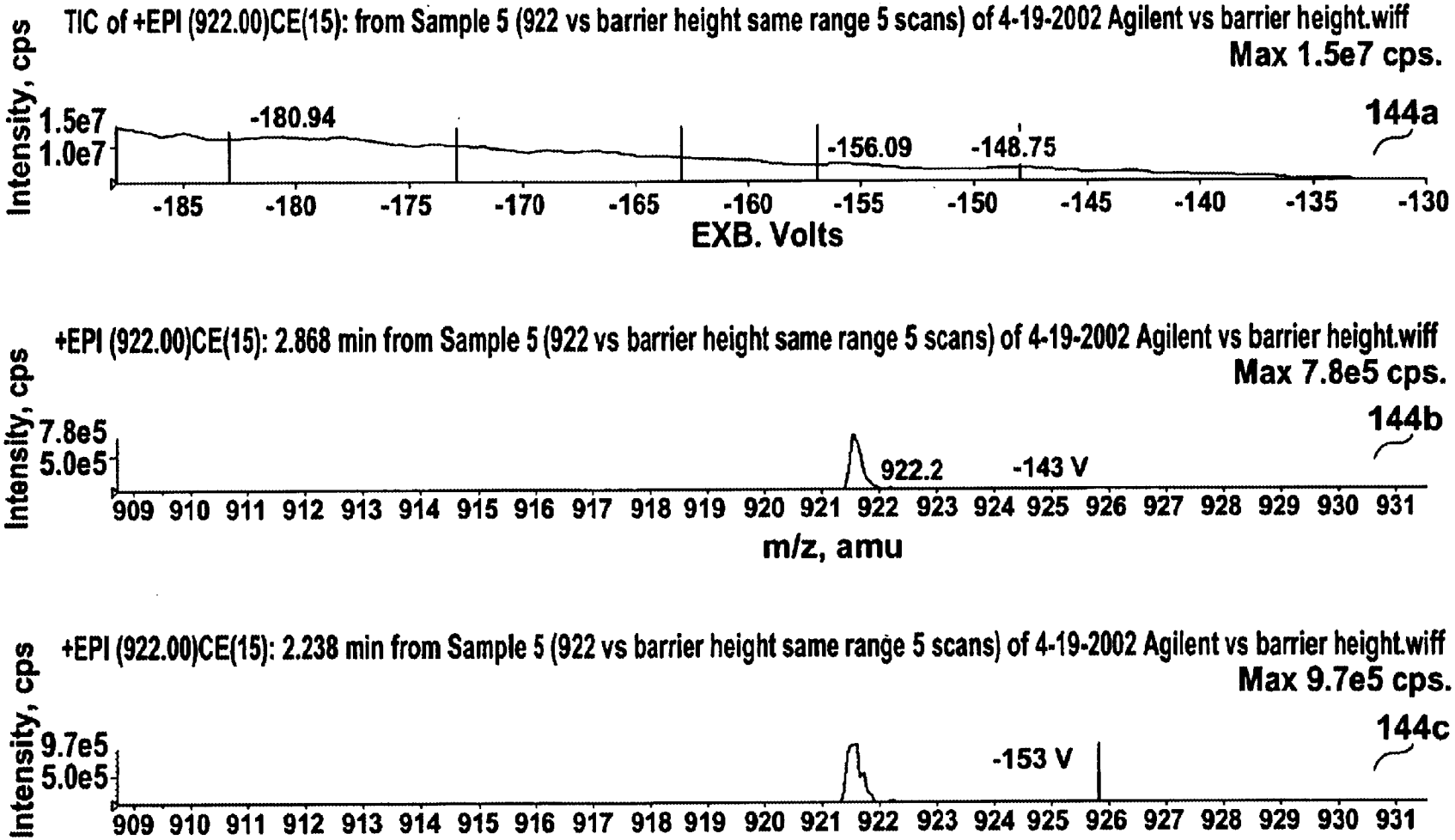
FIG. 4C-a

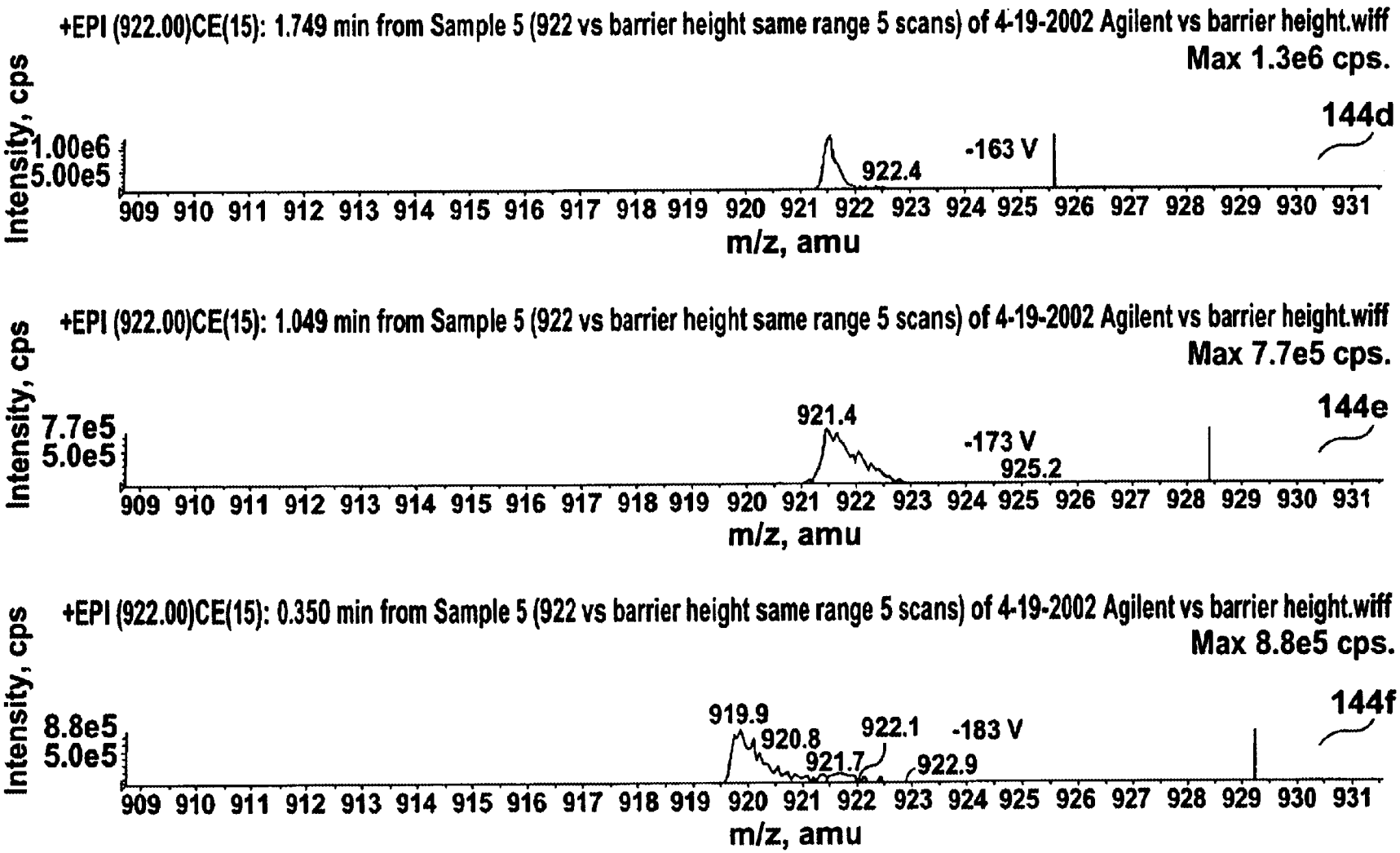
FIG. 4C-b

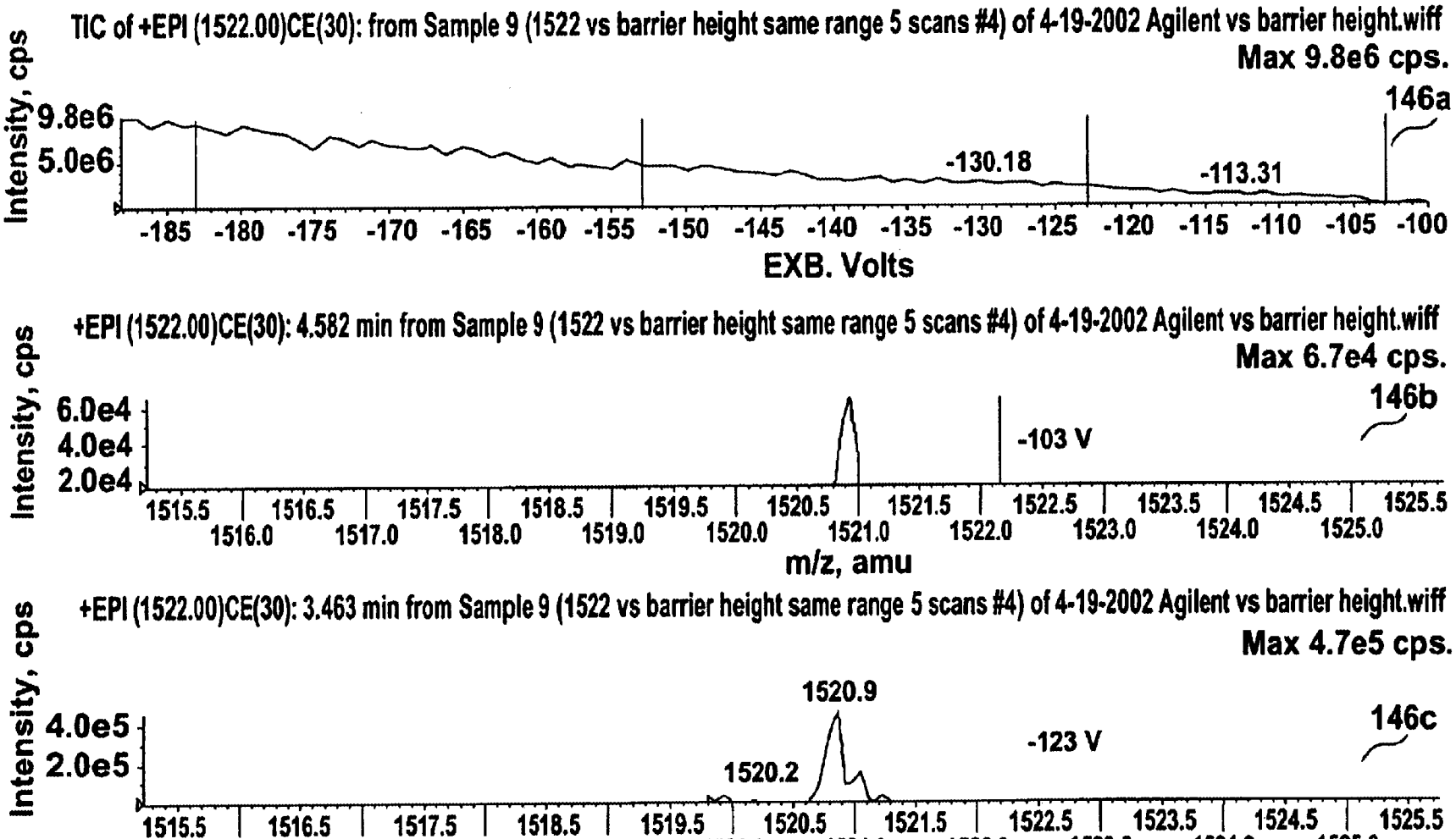
FIG. 4D-a

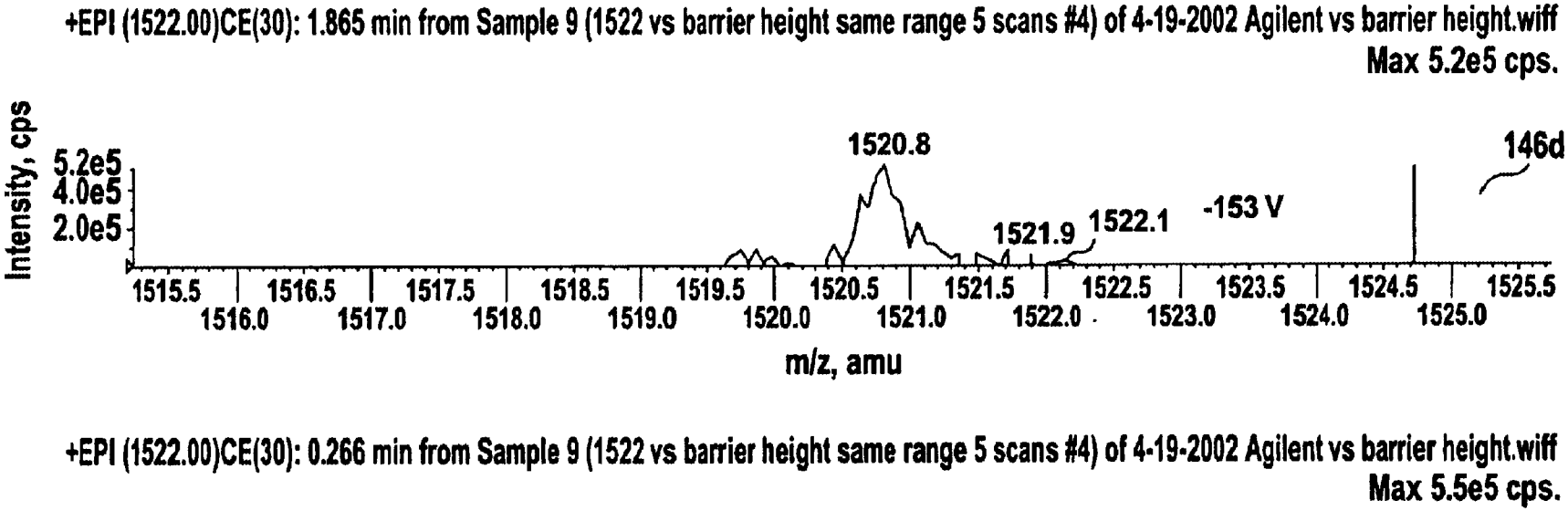
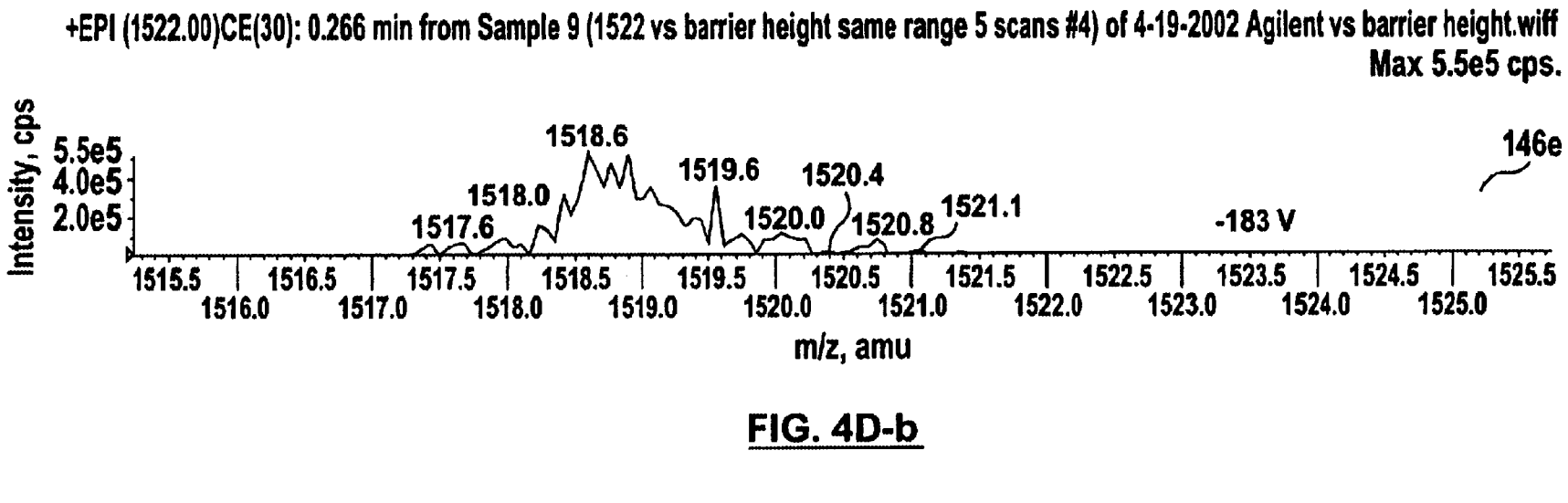
FIG. 4D-b

AXIAL EJECTION RESOLUTION IN MULTIPOLE MASS SPECTROMETERS

FIELD OF INVENTION

The invention generally relates to mass spectrometers, and more particularly to optimized axial ejection techniques in a linear ion trap.

BACKGROUND OF INVENTION

The linear ion trap is characterized by an elongate multipole rod set in which a two dimensional RF field is used to radially trap ions that are contained axially by a DC barrier or trapping field at an exit lens. The linear ion trap has a number of advantages over quadrupole or three-dimensional ion traps, including reduced space charge effects. Linear ion traps are described, inter alia, in U.S. Pat. No. 6,177,668 issued Jan. 23, 2001 to Hager (the "Hager patent"), the entire contents of which are incorporated herein by reference. The Hager patent teaches a variety of axial ejection techniques, in which ions are mass-selectively scanned out of the trap by overcoming the potential barrier at the exit lens. The efficiency, sensitivity, and resolution of particular instances of the axial ejection techniques are briefly discussed.

SUMMARY OF INVENTION

The invention relates to improved axial ejection techniques, and in particular to maximizing the resolution of axial ejection over a wide range of ionic masses.

Broadly speaking, the invention accomplishes this by varying the DC potential barrier between the rods and the exit member of linear ion trap as a function of mass. This is carried out in conjunction with the manipulation of other fields used to axially eject ions mass-selectively. The magnitude of the potential barrier is preferably controlled to vary generally linearly as a function of ion mass-to-charge ratios (m/z), over a pre-determined m/z range. Outside the bounds of the pre-determined m/z range, the barrier field preferably remains stable.

According to one aspect of the invention an improved method of operating a linear ion trap is provided. The linear ion trap includes a DC potential barrier between the rods of the trap and an exit member adjacent to an exit end of the trap. Ions are axially ejected in the improved trap by energizing trapped ions of a selected m/z value and setting the magnitude of the potential barrier based on the selected m/z value in accordance with a pre-determined function, to thereby mass selectively eject at least some ions of a selected n/z value axially from the rod set past the exit member. In the preferred function, the magnitude of the potential barrier is substantially linearly related to the magnitude of the n/z value.

According to another aspect of the invention, there is provided a method of operating a mass spectrometer having an elongated rod set which has an entrance end, an exit end and a longitudinal axis. The method includes: (a) admitting ions into the entrance end of the rod set; (b) trapping at least some of the ions in the rod set by producing a barrier field at an exit member adjacent to the exit end of the rod set and by producing an RF field between the rods of the rod set adjacent at least the exit end of the rod set, wherein the RF and barrier fields interact in an extraction region adjacent to the exit end of the rod set to produce a fringing field; (c) energizing ions in at least the extraction region and varying a potential barrier between the exit member and rod set to mass selectively eject at least some ions of a selected mass-to-charge ratio axially from the rod set past said barrier field; and (d) and detecting at least some of the axially ejected ions. The magnitude of the potential barrier is preferably substantially linearly related to the selected ion mass-to-charge ratio.

In the preferred embodiment, an auxiliary dipole or quadrupole AC voltage is applied to the rod set to assist in axial ejection. The population of ions contained by the linear ion trap is preferably axially ejected therefrom by simultaneously ramping or scanning the RF field, the auxiliary AC field and the DC voltage on the exit lens (or alternatively or additionally a DC offset voltage applied to the rod set). The ions may thus be axially ejected orderly by increasing or decreasing m/z values, depending on the direction (upward or downward) of the ramping, thereby facilitating a mass scan or the collection of mass spectra.

BRIEF DESCRIPTION OF DRAWINGS

The foregoing and other aspects of the invention will become more apparent from the following description of specific embodiments thereof and the accompanying drawings which illustrate, by way of example only and not intending to be limiting, the principles of the invention. In the drawings:

FIGS. 4A-a, 4A-b, 4B-a, 4B-b, 4C-a, 4C-b, 4D-a and 4D-b are charts which show mass spectrums obtained from the apparatus of FIG. 2 for ions of various m/z values under differing DC voltages applied to an exit lens associated with the rod set;

DETAILED DESCRIPTION OF ILLUSTRATIVE EMBODIMENTS

Figure 1A:
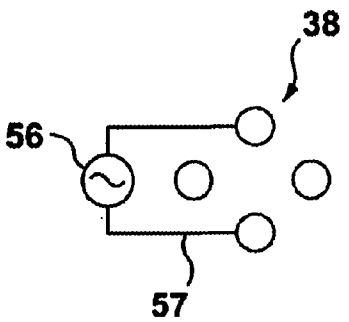
FIG. 1*a* is an end view of a rod set of FIG. 1 and showing electrical connections to the rod set.
Figure 1:
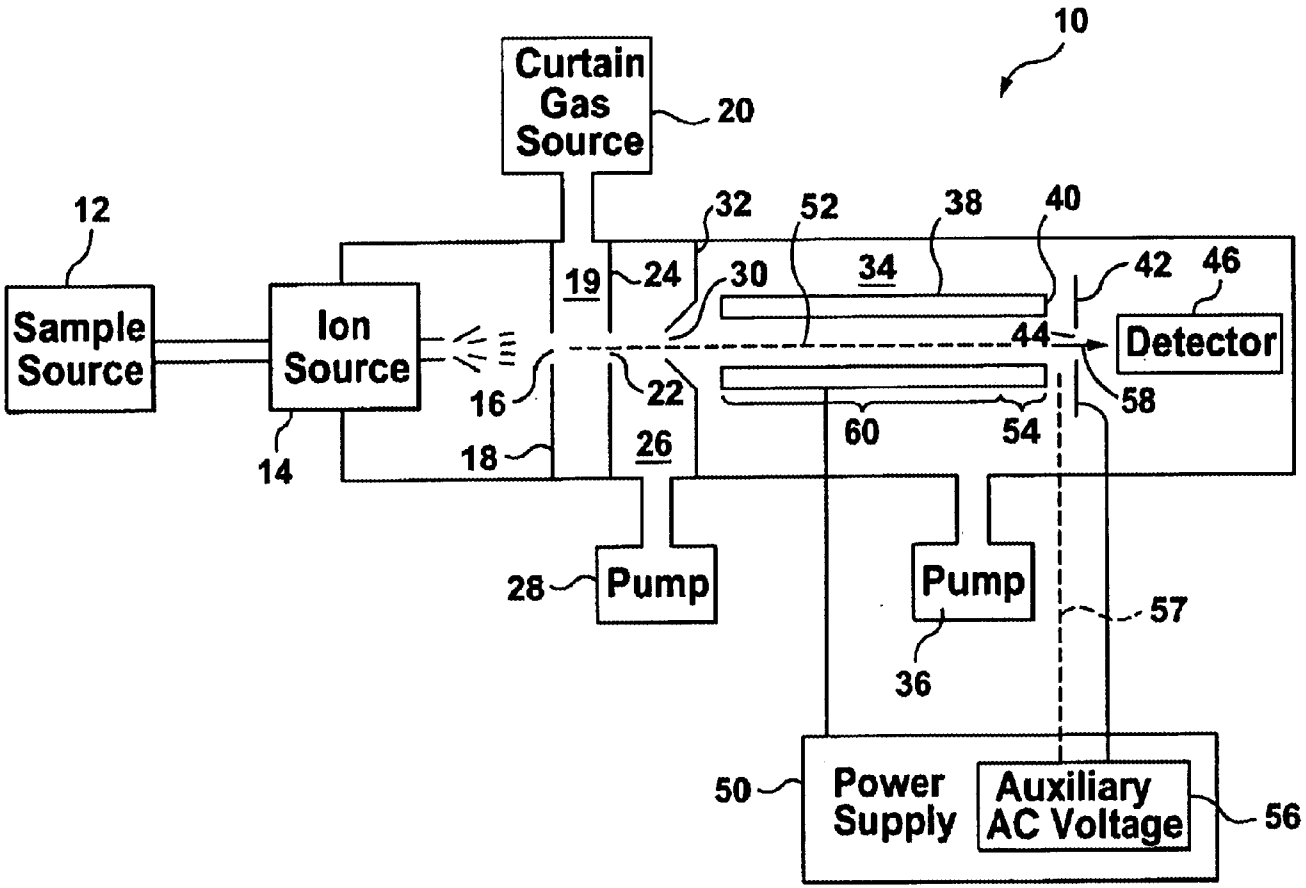
FIG. 1 is a schematic diagram of a relatively simple mass spectrometer apparatus with which the invention may be used.

Referring to FIG. 1, a mass spectrometer apparatus 10 with which the invention may be used is shown. The system 10 includes a sample source 12 (normally a liquid sample source such as a liquid chromatograph) from which sample is supplied to a conventional ion source 14. Ion source 14 may be an electro-spray, an ion spray, or a corona discharge device, or any other known ion source. An ion spray device of the kind shown in U.S. Pat. No. 4,861,988 issued Aug. 29, 1989 to Cornell Research Foundation Inc. is suitable.

Ions from ion source 14 are directed through an aperture 16 in an aperture plate 18. Plate 18 forms one wall of a gas curtain chamber 19 which is supplied with curtain gas from a curtain gas source 20. The curtain gas can be argon, nitrogen or other inert gas and is described in the abovementioned U.S. Pat. No. 4,861,988. The ions then pass through an orifice 22 in an orifice plate 24 into a first stage vacuum chamber 26 evacuated by a pump 28 to a pressure of about 1 Torr.

The ions then pass through a skimmer orifice 30 in a skimmer plate 32 and into a main vacuum chamber 34 evacuated to a pressure of about 2 milli-Torr by a pump 36.

The main vacuum chamber 34 contains a set of four linear conventional quadrupole rods 38. The rods 38 may typically have a rod radius r=0.470 cm, an inter-rod dimension $r_0$=0.415 cm, and an axial length 1=20 cm.

Located about 2 mm past an exit end 40 of the rods 38 is an exit lens 42. The lens 42 is simply a plate with an aperture 44 therein, allowing passage of ions through aperture 44 to a conventional detector 46 (which may for example be a channel electron multiplier of the kind conventionally used in mass spectrometers).

The rods 38 are connected to the main power supply 50 which applies a DC offset voltage to all the rods 38 and also applies RF in conventional manner between the rods. The power supply 50 is also connected (by connections not shown) to the ion source 14, the aperture and orifice plates 18 and 24, the skimmer plate 32, and to the exit lens 42.

By way of example, for positive ions the ion source 14 may typically be at +5,000 volts, the aperture plate 18 may be at +1,000 volts, the orifice plate 24 may be at +250 volts, and the skimmer plate 32 may be at ground (zero volts). The DC offset applied to rods 38 may be −5 volts. The axis of the device, which is the path of ion travel, is indicated at 52.

Thus, ions of interest which are admitted into the device from ion source 14 move down a potential well and are allowed to enter the rods 38. Ions that are stable in the applied main RF field applied to the rods 38 travel the length of the device undergoing numerous momentum dissipating collisions with the background gas. However a trapping DC voltage, typically −2 volts DC, is applied to the exit lens 42. This yields a potential barrier of 3 volts, being the difference between DC voltage on the exit lens 42 (−2 volts) and the DC offset applied to rods 38 (−5 volts). Normally the ion transmission efficiency between the skimmer 32 and the exit lens 42 is very high and may approach 100%. Ions that enter the main vacuum chamber 34 and travel to the exit lens 42 are thermalized due to the numerous collisions with the background gas and have little net velocity in the direction of axis 52. The ions also experience forces from the main RF field which confines them radially. Typically the RF voltage applied is in the order of about 450 volts (unless it is scanned with mass) and is of a frequency of the order of about 816 kHz. No resolving DC field is applied to rods 38.

When a DC trapping or barrier field is created at the exit lens 42 by applying a DC voltage which is higher than the DC voltage applied to the rods 38, the ions stable in the RF field between the rods 38 are effectively trapped.

However ions in region 54 in the vicinity of the exit lens 42 will experience fields that are not entirely quadrupolar, due to the nature of the termination of the main RF and DC fields near the exit lens. Such fields, commonly referred to as fringing fields, will tend to couple the radial and axial degrees of freedom of the trapped ions. This means that there will be axial and radial components of ion motion that are not mutually orthogonal. This is in contrast to the situation at the center of rod structure 38 further removed from the exit lens and fringing fields, where the axial and radial components of ion motion are not coupled or are minimally coupled.

Since the fringing fields couple the radial and axial degrees of freedom of the trapped ions, ions may be scanned mass dependently axially out of the ion trap constituted by rods 38, by the application to the exit lens 42 of a low voltage auxiliary AC signal of appropriate frequency. The auxiliary AC signal may be provided by an auxiliary AC supply 56, which for illustrative purposes is shown as forming part of the main power supply 50. The auxiliary AC voltage is in addition to the trapping DC voltage applied to exit lens 42, and creates an auxiliary AC field which couples to both the radial and axial secular ion motions. When the frequency of the auxiliary AC field matches a radial secular frequency of an ion in the vicinity of the exit lens 42, the ion will absorb energy and will now be capable of traversing the potential barrier present on the exit lens due to the radial/axial motion coupling. When the ion exits axially, it will be detected by detector 46.

The Hager patent discloses a number of other scanning techniques, including:

- Modulating a DC offset voltage applied to the rods 38, to thereby simulate an auxiliary AC signal applied to the exit lens 42 (i.e., no auxiliary AC signal is applied to the exit lens 42, only the trapping DC field).
- Scanning the amplitude of a supplementary or auxiliary AC dipole or quadrupole voltage applied to rods 38 (as indicated by dotted connection 57 in FIG. 1), to produce varying fringing fields which will eject ions axially in the manner described. As is well known, when an auxiliary dipole voltage is used, it is usually applied between an opposed pair of the rods 38, as indicated in FIG. 1*a*.
- Scanning the RF signal applied onto the rods 38 while keeping a DC potential barrier on the exit lens 42 (but with no AC field on the exit lens 42, no modulation of the DC offset on rods 38, and no auxiliary AC signal on rods 38). This technique was stated to be somewhat inefficient in that, while ions in the fringing fields at the downstream ends of rods 38 will leave axially mass dependently and be detected, most of the ions upstream of the fringing fields will leave radially and be wasted.
- Applying a fixed, low level, auxiliary dipolar or quadrupolar AC field to the rods 38 and then scanning the amplitude of the RF field.
- Scanning the frequency of an auxiliary dipolar or quadrupolar AC field applied to the rods 38 while keeping the RF field fixed.

In each of the foregoing techniques, a DC potential barrier exists between the rods 38 and the exit lens 42. The ions must overcome this potential barrier in order to be axially ejected. Through experiments described in greater detail below, the inventors have determined that the foregoing and/or other axial ejection techniques may be improved by varying the DC potential barrier in conjunction with the manipulation of one or more of the other fields enumerated above required to axially eject ions mass-selectively. The magnitude of the potential barrier is preferably controlled to vary generally linearly as a function of ion mass-to-charge ratios (m/z), over a predetermined mass range. Outside the bounds of the pre-determined m/z range, the potential barrier preferably remains stable.

Figure 2:
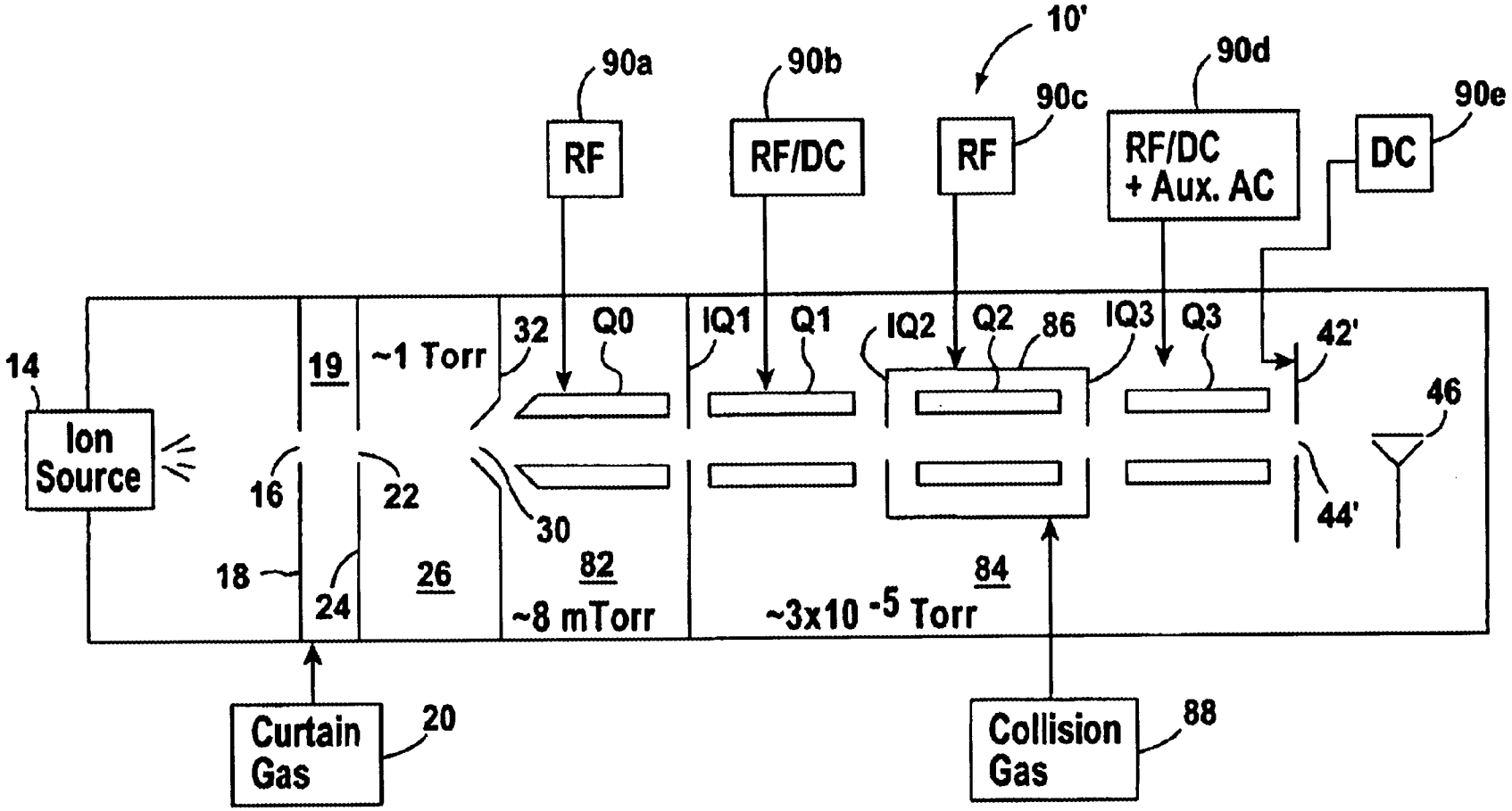
FIG. 2 is a schematic diagram of a more complex mass spectrometer apparatus with which the invention may be used.
Figure 3:
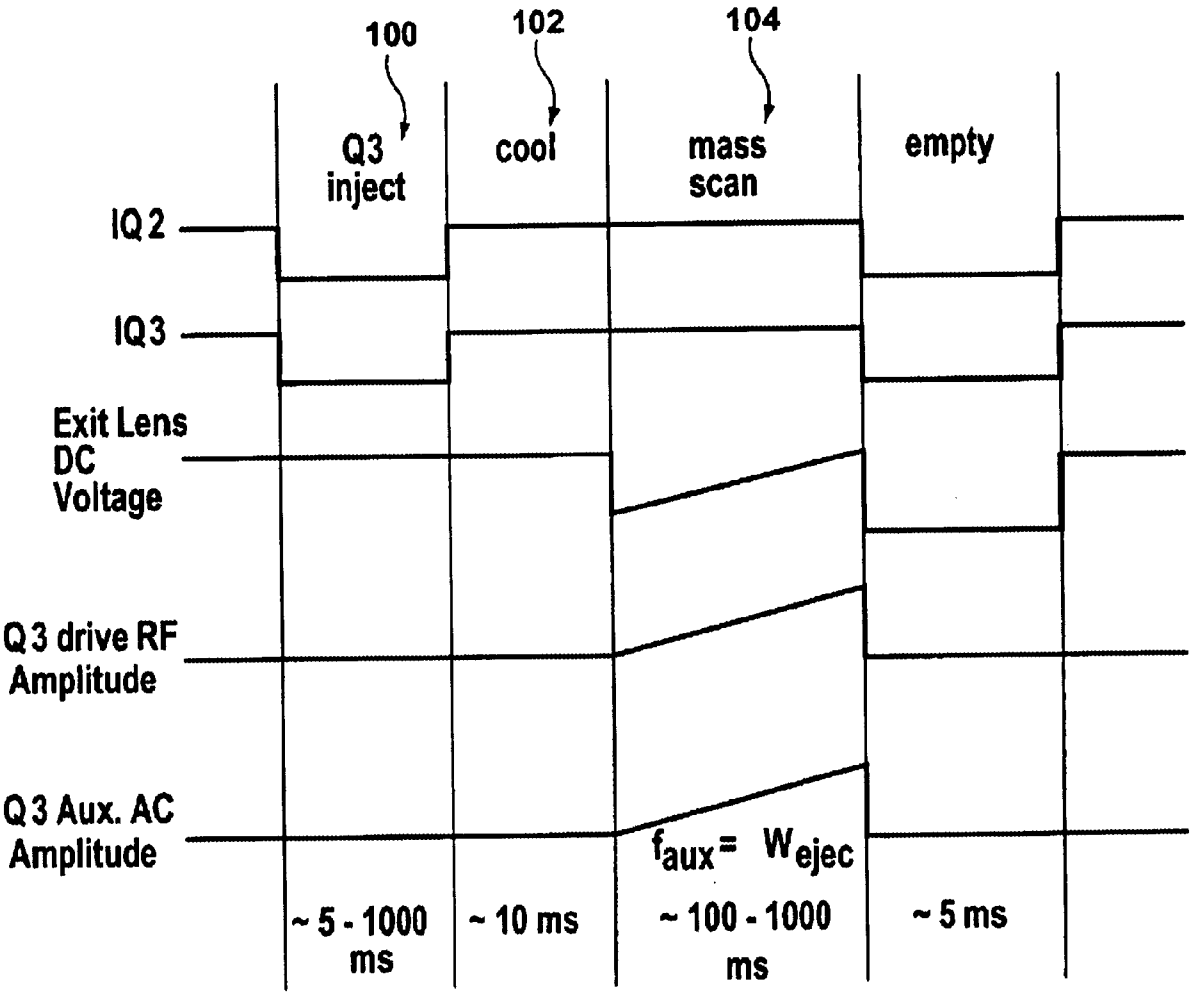
FIG. 3 is a timing diagram showing, in schematic form, signals applied to a quadrupole rod set of the apparatus of FIG. 2 in order to inject, trap, and mass-selectively eject ions axially from the rod set.

FIG. 2 illustrates a mass spectroscopy apparatus 10' similar to that shown in FIG. 1 upon which a number of experiments were conducted to determine the optimal magnitude of the exit barrier field for maximizing the resolution of axial ejection. In FIGS. 1 and 2, corresponding reference numerals indicate corresponding parts, and only the differences from FIG. 1 are described. FIG. 3 is a timing diagram which shows, in schematic form, signals applied to the "Q3"

rod set of the apparatus 10' in order to inject, trap, and mass-selectively eject ions axially from Q3.

In apparatus 10', ions pass through the skimmer plate 32 into a second differentially pumped chamber 82. Typically, the pressure in chamber 82, often considered to be the first chamber of the mass spectrometer, is about 7 or 8 mTorr.

In the chamber 82, there is a conventional RF-only multipole ion guide Q0. Its function is to cool and focus the ions, and it is assisted by the relatively high gas pressure present in the chamber 82. This chamber also serves to provide an interface between the atmospheric pressure ion source 14 and the lower pressure vacuum chambers, thereby serving to remove more of the curtain gas from the ion stream, before further processing.

An inter-quad aperture IQ1 separates the chamber 82 from a second main vacuum chamber 84. A quadrupole rod set Q1 is located in the vacuum chamber 84, which is evacuated to approximately 1 to $3\times10^{-5}$ Torr. A second quadrupole rod set Q2 is located in a collision cell 86, supplied with collision gas 88. The collision cell 86 is designed to provide an axial field toward the exit end as taught by Thomson and Jolliffe in U.S. Pat. No. 6,111,250, the entire contents of which are incorporated herein by reference. The cell 86 is typically maintained at a pressure in the range $5\times10^{-4}$to $10^{-2}$ Torr and includes inter-quad apertures IQ2, IQ3 at either end. Following Q2 is located a third quadrupole rod set Q3, and an exit lens 42'. Opposite rods in Q3 are preferably spaced apart approximately 8.5 mm, although other spacings are contemplated and may be used in practice. The distance between the ends of the rods in Q3 and the exit lens 42' is approximately 3 mm, although other spacings are contemplated and may be used in practice, since this is not an essential parameter. The pressure in the Q3 region is nominally the same as that for Q1, namely 1 to $3\times10^{-5}$ Torr. Detector 46 is provided for detecting ions exiting through the exit lens 40.

Power supplies 90 are connected to the quadrupoles Q0, Q1, Q2, and Q3, as shown. Q0 is an RF-only multi-pole ion guide. Q1 is a standard resolving RF/DC quadrupole, the RF and DC voltages being chosen to transmit only precursor ions of interest or a range of ions into Q2. Q2, functioning within a collision cell, is operated as an RF-only multi-pole guide. Q3 operates as a linear ion trap. Ions are scanned out of Q3 in a mass dependent manner using an axial ejection technique, described in greater detail below.

In the experiments discussed below, the ion source was an ion spray device which produced ions from a standard calibration solution, including ions of known m/z values, supplied by a syringe pump. Q1 was operated as an RF-only multi-pole ion guide, and the DC potential difference between Q1 and IQ2 was controlled to provide collisional energies of about 15 eV. Q3 therefore trapped the precursor ions as a well as disassociated fragments thereof.

FIG. 3 shows the timing diagrams of waveforms applied to the quadrupole Q3 in greater detail. In an initial phase 100, a DC blocking potential on IQ3 is dropped so as to permit the linear ion trap to fill for a time preferably in the range of approximately 5×1000 ms, with 50 ms being preferred.

Next, an optional cooling phase 102 follows in which the ions in the trap are allowed to cool or thermalize for a period of approximately 10 ms in Q3. The cooling phase is optional, and may be omitted in practice.

A mass scan or mass analysis phase 104 follows the cooling phase, in which ions are axially scanned out of Q3 in a mass dependent manner. In the illustrated embodiment, an auxiliary dipole AC voltage, superimposed over the RF voltage used to trap ions in Q3, is applied to one set of pole pairs, in the x or y direction. The frequency of the auxiliary AC voltage is preferably set to a predetermined frequency $\omega_{ejec}$ known to effectuate axial ejection. (Each linear ion trap may have a somewhat different frequency for optimal axial ejection based on its exact geometrical configuration.) Simultaneously, the amplitudes of the Q3 RF voltage and the Q3 auxiliary AC voltage are ramped or scanned. Experiments were conducted to find the optimal DC potential barrier that would maximize the resolution of axial ejection.

The experimental data is shown FIGS. 4A–4D. In each of these drawings, the top frame show the DC voltage applied to the exit lens 42' (i.e., the "exit lens voltage") being ramped, followed by frames showing the spectra that span a mass of interest. The masses of interest are m/z=322, m/z=622, m/z=922 and m/z=1522, respectively shown in FIGS. 4A–4D. (Note that in these spectrograms the ions of interest were produced as a result of fragmentation in the collision cell. The spectrograms are this MS/MS spectra, with the precursor ions not shown.)

Each of the spectra are related to a specific barrier voltage. For example, in FIG. 4A, the mass of interest is m/z=322 and the exit lens voltage changes from −188 V to −150 V, as seen in the top frame 140*a*. The total ion current is plotted as a function of exit lens voltage. A constant DC offset voltage of −190 V is applied to the rods of Q3, so the potential barrier that must be overcome by the ions in order to be axially ejected is equal to the exit lens voltage minus the DC offset voltage applied to the rods. For instance, an exit lens voltage of −160 V corresponds to a potential barrier of 30 volts.

The $2^{nd}$ frame 140*b* indicates that when the exit lens voltage is at −163 V, no m/z=322 ions are ejected. The $3^{rd}$ frame 140*c* indicates that ions are ejected when the exit lens voltage is at −173 V. The $4^{th}$ frame 140*d* shows the ion signal when the exit lens voltage is at −183 V.

In FIG. 4B, the mass of interest is m/z=622 and the exit lens voltage changes from −188 V to −150 V, as seen in top frame 142*a*. Frames 142*b*–142*e* show the spectra recorded at exit lens voltages of −153.1 V, −163.1 V, −173.1 V, and −183.1 V, respectively.

In FIG. 4C, the mass of interest is m/z=922 and the exit lens voltage changes from −190 V to −130 V, as seen in top frame 144*a*. Frames 144*b*–144*f* show the spectra recorded at exit lens voltages of −143 V, −153 V, −163 V, −173 and −183 V, respectively.

In FIG. 4D, the mass of interest is m/z=1522 and the exit lens voltage changes from −190 V to −100 V, as seen in top frame 146*a*. Frames 146*b*–146*f* show the spectra recorded at exit lens voltages of −143 V, −153 V, −163 V, −173 and −183 V, respectively.

From FIGS. 4A–4D, it will be seen that there is an optimum exit lens voltage for each of the different m/z values which maximizes the resolution of the ion signal, as determined by the full width half maximum value (FWHM) or m/Δm of each spectrum. The exit lens voltage increases as a function of mass, but only to a certain extent. Once the optimum exit lens voltage is reached, increasing the magnitude of the potential barrier further only reduces the signal resolution. For example, the optimized exit lens values for the specific geometry of apparatus 10' are shown in Table 1 below:

TABLE 1

(data acquired at 1000 amu/s scan speed)

| m/z | Exit Lens Voltage | Potential Barrier (V) |
|---|---|---|
| 322 | −177 | 13 |
| 622 | −168 | 22 |
| 922 | −157 | 33 |
| 1522 | −135 | 55 |

Figure 6:
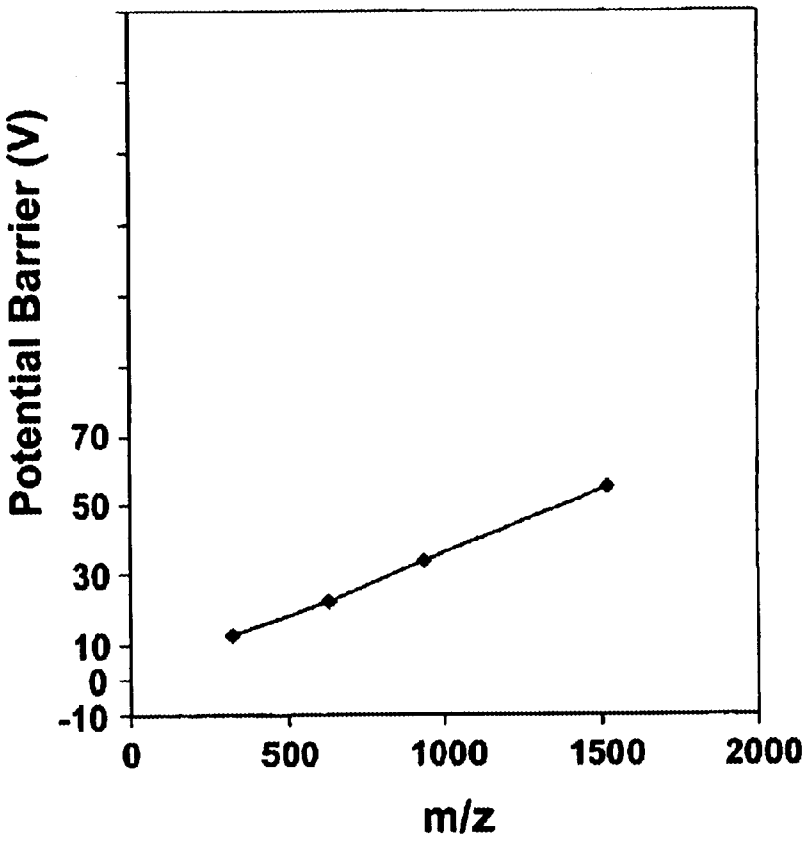
FIG. 6 is a graph, corresponding to the graph of FIG. 5, showing the optimal potential barriers.
Figure 5:
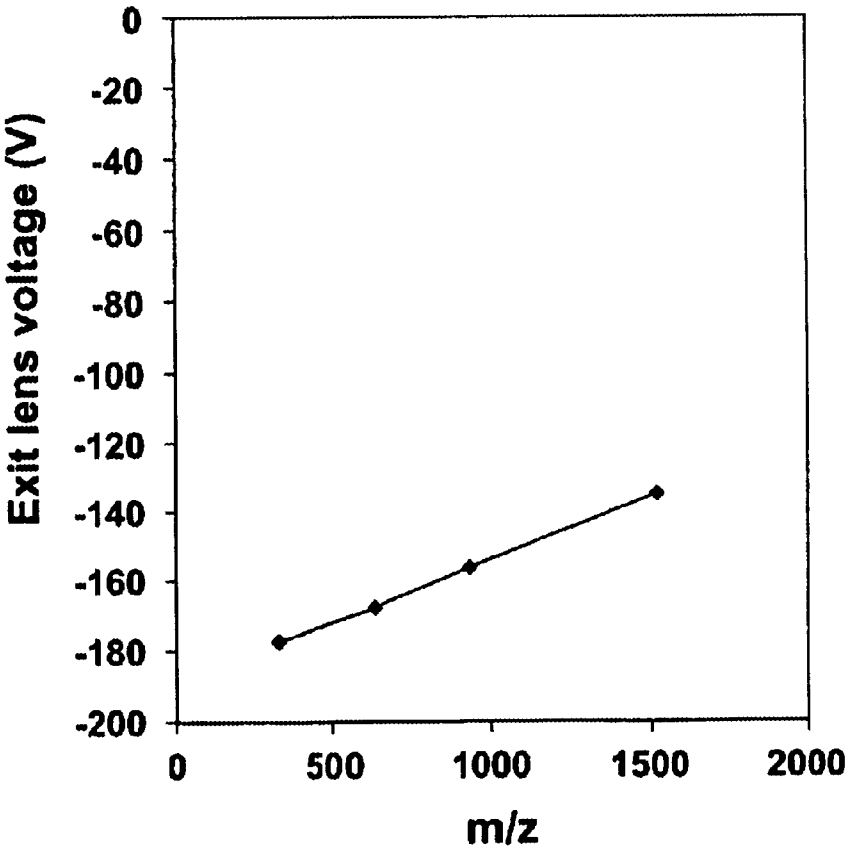
FIG. 5 is a graph illustrating optimal DC voltages on the exit lens as a function of mass (when a DC offset is applied to the rods) for maximizing the resolution of ion signals produced by axial ejection.

This data is plotted in FIG. 5, which shows the absolute exit lens voltage, and FIG. 6, which shows the data in terms of the relative potential barrier.

From the plots in FIGS. 5 and 6, it will be seen that the optimal potential barrier is substantially linearly related to the magnitude of the mass-to-charge ration of the ion selected for axial ejection. Thus, as shown in FIG. 3, by scanning or ramping the DC voltage on the exit lens 42' in conjunction with the scanning or ramping of the RF auxiliary AC fields, the resolution obtained through axial ejection can be maximized over a wide mass range. It will be also be appreciated that the same effect can be accomplished by keeping the DC voltage on the exit lens constant and ramping or scanning the DC offset applied to the rods of Q3, since that is an alternative method of varying the potential barrier between the rods of Q3 and the exit lens 42'.

It should also be appreciated that one of the advantages provided by apparatus 10' is a relatively high efficiency of axial ejection, despite the fact that the RF field is ramped. Ordinarily, ramping the RF field in isolation results in low efficiency because most of the ions upstream of the fringing fields will leave radially and be wasted (i.e., not counted by detector 46). However, by simultaneously applying and ramping the auxiliary AC field and the trapping potential barrier, efficiency can be increased. This is because, during a mass scan (from low to high masses), if the potential barrier is fixed at a high level then the lower masses will not be able to overcome the barrier unless enough energy is imparted to them. However, as more energy is applied, the low masses will most likely be ejected radially before overcoming the axial barrier. By ramping the axial potential barrier with mass, the probability of axial ejection increases. Efficiencies on the order of 15% have been obtained with the apparatus 10'.

It will be understood to those skilled in the art that many of the operating parameters described herein are specific to the geometry of the mass spectrometers, and will vary depending on the geometry or dimensions of any specific product. Accordingly, the operating parameters should be understood as being illustrative only, and not intended to be limiting. Similarly, those skilled in the art will understand that numerous modifications and variations may be made to the embodiments described herein without departing from the spirit or scope of the invention.

We claim:

1. An improved method of operating a linear ion trap having a multipole rod set and an exit member wherein a DC potential barrier is produced between the rod set and the exit member to trap ions, the improvement comprising energizing trapped ions of a selected m/z value and setting the magnitude of the potential barrier based on the selected m/z value in accordance with a pre-determined function, to thereby axially eject at least some ions of the selected m/z value from the rod set past the exit member.

2. A method according to claim 1, wherein the pre-determined function substantially linearly relates the magnitude of the potential barrier with the magnitude of the selected m/z value.

3. A method according to claim 2, wherein the potential barrier is provided by a DC field.

4. A method according to claim 3, including producing an RF field between the rods of the rod set to radially contain ions.

5. A method according to claim 4, including producing an auxiliary AC field between at least two of the rods of the rod set in order to energize the trapped ions past the exit member.

6. A method according to claim 5, including scanning simultaneously the RF field, the auxiliary AC field and the potential barrier in order to maximize the resolution of axial ejection.

7. A method according to claim 1, wherein a DC voltage is applied to the exit member and the potential barrier is varied by varying the DC voltage applied to the exit member.

8. A method according to claim 1, wherein a DC offset voltage is applied to the rods of the rod set and a DC voltage is applied to the exit member, the potential barrier being varied by varying at least one of the rod offset voltage and the exit member voltage.

9. A method of operating a mass spectrometer having an elongate rod set which has an entrance end, an exit end and a longitudinal axis, the method including:

(a) admitting ions into the entrance end of the rod set;

(b) trapping at least some of the ions in the rod set by producing a barrier field at an exit member adjacent to the exit end of the rod set and by producing an RF field between the rods of the rod set adjacent at least the exit end of the rod set, wherein the RF and barrier fields interact in an extraction region adjacent to the exit end of the rod set to produce a fringing field;

(c) energizing ions in at least the extraction region and varying the barrier field between the rod set and the exit member to mass selectively eject at least some ions of a selected mass-to-charge ratio axially from the rod set; and (d) detecting at least some of the axially ejected ions.

10. A method according to claim 9, wherein the magnitude of the barrier field is varied in accordance with the magnitude of the selected m/z value.

11. A method according to claim 10, wherein the magnitude of the barrier field is substantially linearly related to the magnitude of the selected m/z value.

12. A method according to claim 2, wherein the barrier field is a DC field.

13. A method according to claim 12, wherein a DC offset voltage is applied to the rods of the rod set and a DC voltage is applied to the exit lens, the magnitude of the barrier field being varied by varying at least one of the rod offset voltage and the exit lens voltage.

14. A method according to claim 13, including producing an auxiliary AC field between at least two of the rods of the rod set in order to energize the trapped ions past the exit lens.

15. A method according to claim 14, including scanning simultaneously the RF field, the auxiliary AC field and the barrier field in order to maximize the resolution of axial ejection.

* * * * *